US005392990A

United States Patent [19]

Iwata et al.

[11] Patent Number: 5,392,990

[45] Date of Patent: Feb. 28, 1995

[54] FIREFIGHTING DOUBLE-NOZZLE DELUGE GUN AND CONTROL METHOD THEREOF

[75] Inventors: Teruo Iwata, Hachiouji; Toshihide Tsuji, Sagamihara; Shuji Matsumoto; Katsuaki Tonomura, both of Hachiouji, all of Japan

[73] Assignee: Hochiki Kabushiki Kaisha, Tokyo, Japan

[21] Appl. No.: 231,883

[22] Filed: Apr. 22, 1994

Related U.S. Application Data

[63] Continuation of Ser. No. 18,887, Feb. 17, 1993, abandoned.

[30] Foreign Application Priority Data

Feb. 28, 1992 [JP] Japan ..... 4-042583

[51] Int. Cl.[6] ..... B05B 3/08

[52] U.S. Cl. ..... 239/232; 239/DIG. 1; 239/243; 239/504; 239/513; 239/587.6

[58] Field of Search ..... 239/543, 502, 243, 504, 239/263.1, 513, DIG. 1, 288, 232, 587.1–587.6; 169/51, 52, 16, 24, 46, 47

[56] References Cited

U.S. PATENT DOCUMENTS

| | | | |
|---|---|---|---|
| 1,230,458 | 6/1917 | Bouery | 239/513 X |
| 2,086,724 | 7/1937 | McAulay | 239/513 X |
| 2,235,577 | 3/1971 | Evans | 239/288 |
| 2,419,393 | 4/1947 | Doyle | 239/543 X |
| 4,409,329 | 3/1990 | Yoshida et al. | 239/69 X |
| 4,984,740 | 1/1991 | Hodge | 239/513 X |

FOREIGN PATENT DOCUMENTS

| | | | |
|---|---|---|---|
| 527570 | 2/1958 | Italy | 239/587.6 |
| 123828 | 12/1942 | Sweden | 239/547 |
| 1533766 | 1/1990 | U.S.S.R. | 239/543 |

*Primary Examiner*—David M. Mitchell
*Assistant Examiner*—Kevin Weldon
*Attorney, Agent, or Firm*—Max Fogiel

[57] ABSTRACT

A double-nozzle deluge gun has a pair of nozzles arranged side by side rotatably on a rotatable table and an inter-nozzle control unit for adjusting the inter-nozzle angle measured between two lines obtained by projecting the radiation center lines of the nozzles onto a horizontal plane. Each nozzle has a deflector which is positioned in front of the nozzle during the very short range mode. Each deflector has a side cover which prevents water having passed through the deflector from excessively spreading sideways. The inter-nozzle angle and the water pressure are adjusted in accordance with desired water-reaching ranges, so as to achieve an optimal watering pattern in any range. Thus, the double-nozzle deluge gun can be controlled in accordance with desired water-reaching ranges, so as to achieve an optimal watering pattern having an appropriate width in any range.

8 Claims, 7 Drawing Sheets

FIG. 1a
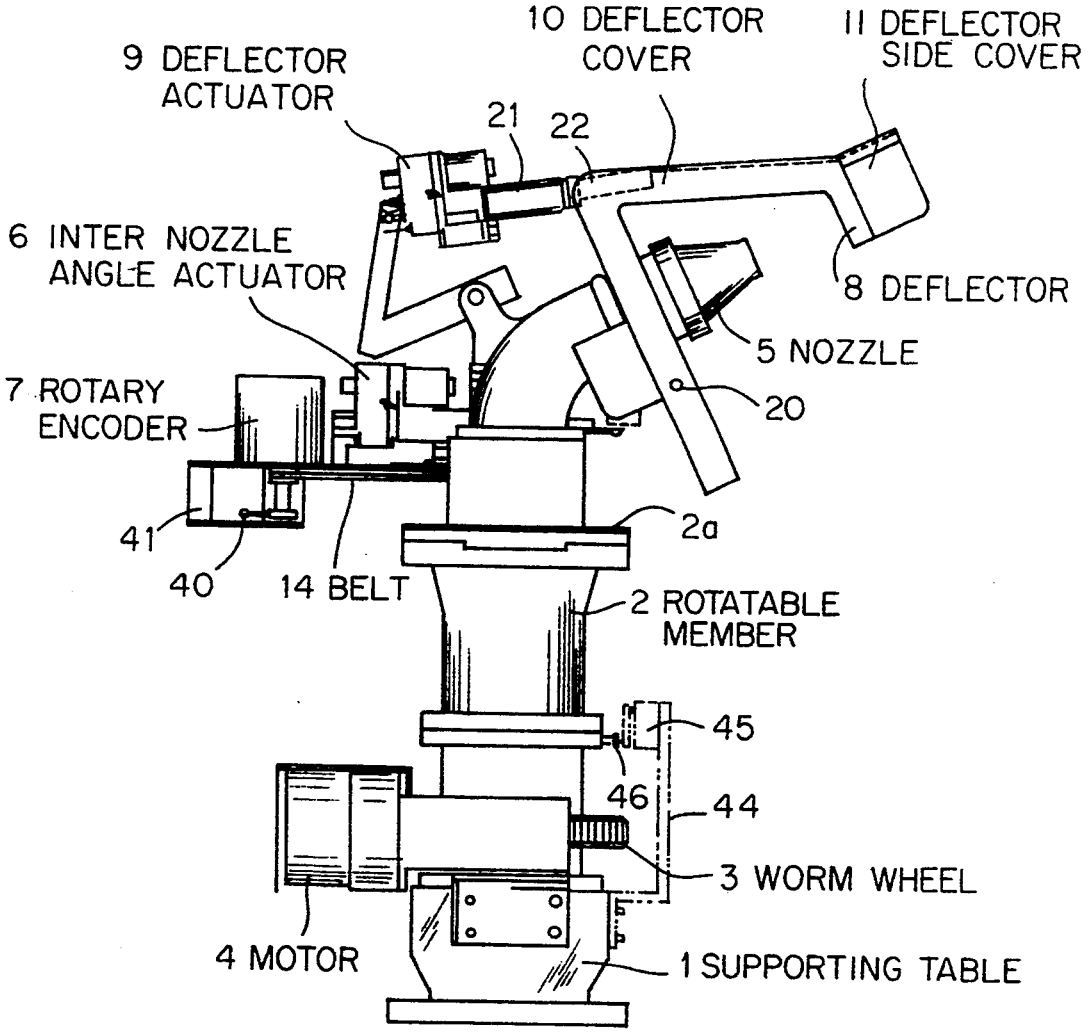
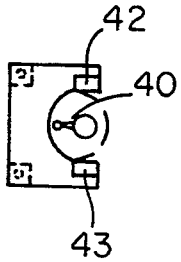
FIG. 1b

| | RANGES | ANGLES | PRESSURES | USE OF DEFLECTORS |
|---|---|---|---|---|
| LONG | 40m~50m | 0° | 7 kgf/cm² | UNUSED |
| INTER-MEDIATE | 30m~50m | 5° | 5 kgf/cm² | UNUSED |
| SHORT | 18m~35m | 8° | 3 kgf/cm² | USED |
| VERY-SHORT | 0m~20m | 8° | 5 kgf/cm² | USED |

FIREFIGHTING DOUBLE-NOZZLE DELUGE GUN AND CONTROL METHOD THEREOF

The present application is a continuation of the parent application Ser. No. 018,887, filed Feb. 17, 1993, now abandoned.

BACKGROUND OF THE INVENTION

1. Field of the Invention

The present invention relates to a firefighting double-nozzle deluge gun which is controlled in accordance with a water-reaching range so that an optimal watering pattern can be obtained in any water-reaching range.

2. Description of the Related Art

Deluge guns for shooting water or fire extinguishing liquids from nozzles to fire sources are known as one type of firefighting devices which are provided in buildings such as hotels, schools and atriums.

The water-reaching range of a firefighting deluge gun is controlled by adjusting the shooting pressure and/or the elevation angle of the nozzle. If the nozzle is maintained at a certain elevation angle and the shooting pressure is varied, the water-reaching range varies in accordance with the shooting pressures, and the watering pattern (a pattern of area which receives a predetermined amount of water or more per a unit of time) varies with the water-reaching ranges, as indicated in FIG. 8.

However, watering by using a known firefighting deluge gun having one nozzle results in a spindle-shaped watering pattern, as shown in FIG. 8, which becomes narrower toward the front and rear ends thereof. Thus, the known firefighting single-nozzle deluge guns are liable to fail to achieve substantially wide watering patterns. Particularly, during a short-range operation, the watering pattern becomes narrow, in other words, it becomes a bar-shape instead of a spindle-shape, and, thus, the effective watering area becomes inconveniently small.

To enhance the fire extinguishing performance, there has been provided a deluge gun having two nozzles.

Japanese Patent Application Laid-open No. 60-7124 discloses one type of double-nozzle deluge gun in which the two nozzles are parallelly operated about a single rotation axis and a single swing (elevation angle) axis so as to always face in the same direction. Japanese Patent Application Laid-open No. 60-160851 discloses another type of double-nozzle deluge gun comprising a nozzle for short-range watering and a nozzle for long-range watering. In these double-nozzle deluge guns, the water-reaching range is varied by varying the shooting pressure and/or the elevation angle of the nozzle, or selectively using the nozzles with different ranges.

However, watering by using a known firefighting deluge gun having one nozzle results in a spindle-shaped watering pattern, as shown in FIG. 8, which becomes narrower toward the front and rear ends thereof. Thus, the known firefighting single-nozzle deluge guns are liable to fail to achieve substantially wide watering patterns. Particularly, during a short-range operation, the watering pattern becomes narrow, in other words, it becomes a bar-shape instead of a spindle-shape, and, thus, the effective watering area becomes inconveniently small.

While, a double-nozzle deluge gun having nozzles of the same type (with the same water-reaching ranges) has a problem in that the watering areas of the individual nozzles are liable to become separated during a short-range watering operation because the widths of the watering areas are reduced during the operation. Further, a double-nozzle deluge gun having nozzles with different ranges has a problem in that the width of the watering pattern of the long-range nozzle is reduced as the range is decreased, similar to the case of the watering pattern of the single-nozzle deluge gun.

SUMMARY OF THE INVENTION

The present invention is intended to eliminate the problems of the related art. Accordingly, an object of the present invention is to provide a firefighting double-nozzle deluge gun which has a pair of nozzles and always achieves an optimal watering pattern having an appropriate width in any range from a long range to a short range and, further, to a very short range.

To achieve these objects, the present invention provides a firefighting double-nozzle deluge gun comprising: a pair of nozzles provided side by side rotatably on a rotatable table; and inter-nozzle angle control means for controlling the angle between the pair of nozzles, the angle being measured between two lines obtained by projecting the radiation center lines of the pair of nozzles onto a horizontal plane.

According to the present invention, the above-described firefighting double-nozzle deluge gun may further comprise a pair of deflectors provided for the respective nozzles. Each deflector is positioned in front of the nozzle during a short range watering operation. Further, each deflector has a side cover for preventing a water stream having passed through the deflector from excessively spreading sideways.

Still further, according to the present invention, the above-described firefighting double-nozzle deluge gun may comprise control means for adjusting the angle between the pair of nozzles and the water-shooting pressure in accordance with desired water-reaching ranges, so as to achieve an optimal watering pattern.

The above-described firefighting double-nozzle deluge gun of the present invention can maintain substantially the same width of the watering patterns in all the water-reaching ranges by controlling the angle between the nozzles and the water-shooting pressure in accordance with desired water-reaching ranges. In other words, a substantially wide watering pattern can be achieved in any range. Therefore, the firefighting double-nozzle deluge gun of the present invention can effectively water to extinguish a fire. For example, if a long water-reaching range is desired, the inter-nozzle angle is set to 0° and the water-shooting pressure is increased. For a reduced water-reaching range, the water-shooting pressure is reduced and the inter-nozzle angle is increased so as to retain a substantial width of the watering pattern.

If the nozzles are very close to a fire, the deflectors are positioned in front of the nozzles so as to effectively water to the fire. Because the deflectors are formed in suitable shapes, water passing through the deflectors assumes an optimal watering pattern, that is, a substantially rectangular pattern having a substantially great width all along the length, even in a very short range. Further, because each deflector has a side cover for preventing water from excessively spreading sideways, an optimal watering pattern can be achieved even in a very short range. Thus, the firefighting double-nozzle deluge gun of the present invention can effectively water to extinguish a fire even in a very short range.

Further objects, features and advantages of the present invention will become apparent from the following description of the invention with reference to the attached drawings.

BRIEF DESCRIPTION OF THE DRAWINGS

FIGS. 1(*a*) and 1(B) are overall and partial sectional views of an embodiment of the firefighting double-nozzle deluge gun of the present invention.

DESCRIPTION OF THE PREFERRED EMBODIMENTS

Figure 2:
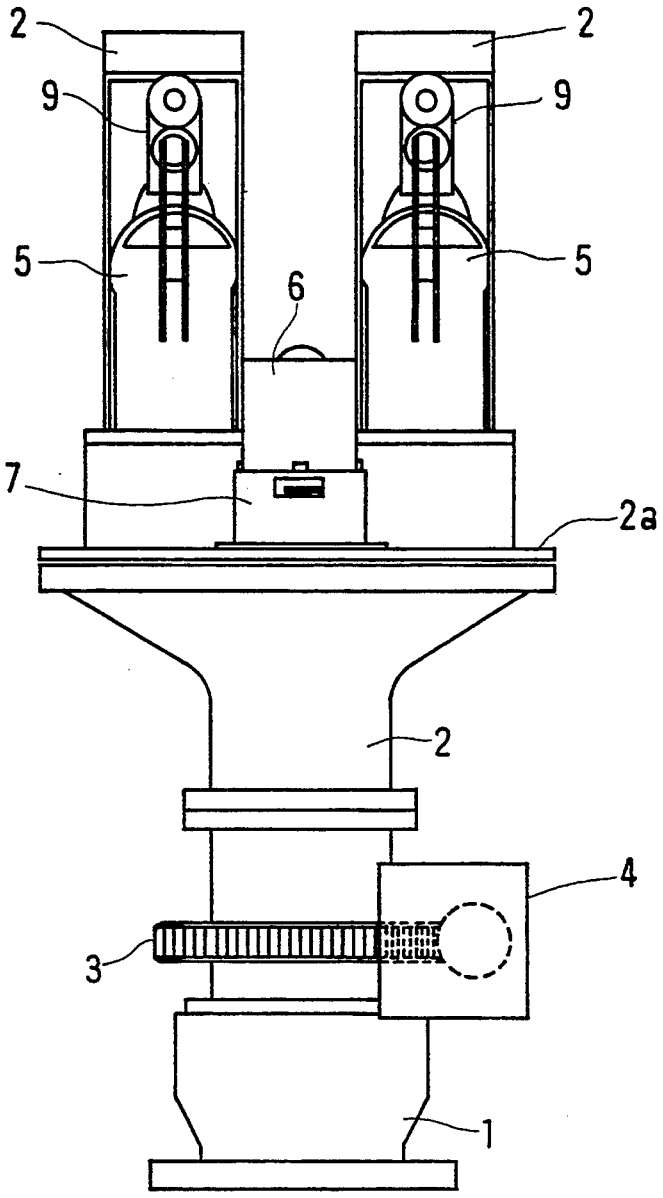
FIG. 2 is a rear view of the embodiment shown in FIG. 1.

A double-nozzle deluge gun according to an embodiment of the present invention is constructed as shown in FIG. 1(A). A supporting platform 1 supports a rotatable member 2 which is rotatably connected thereto. The rotatable member 2 is firmly connected to a worm wheel 3. The worm wheel 3 is engaged with a worm gear which is rotated by a motor 4 fixed to the supporting table 1. Thus, the rotatable member 2 can be horizontally rotated relative to the supporting table 1. The supporting table 1 and the rotatable member 2 are tubular members having empty spaces inside.

Figure 3:
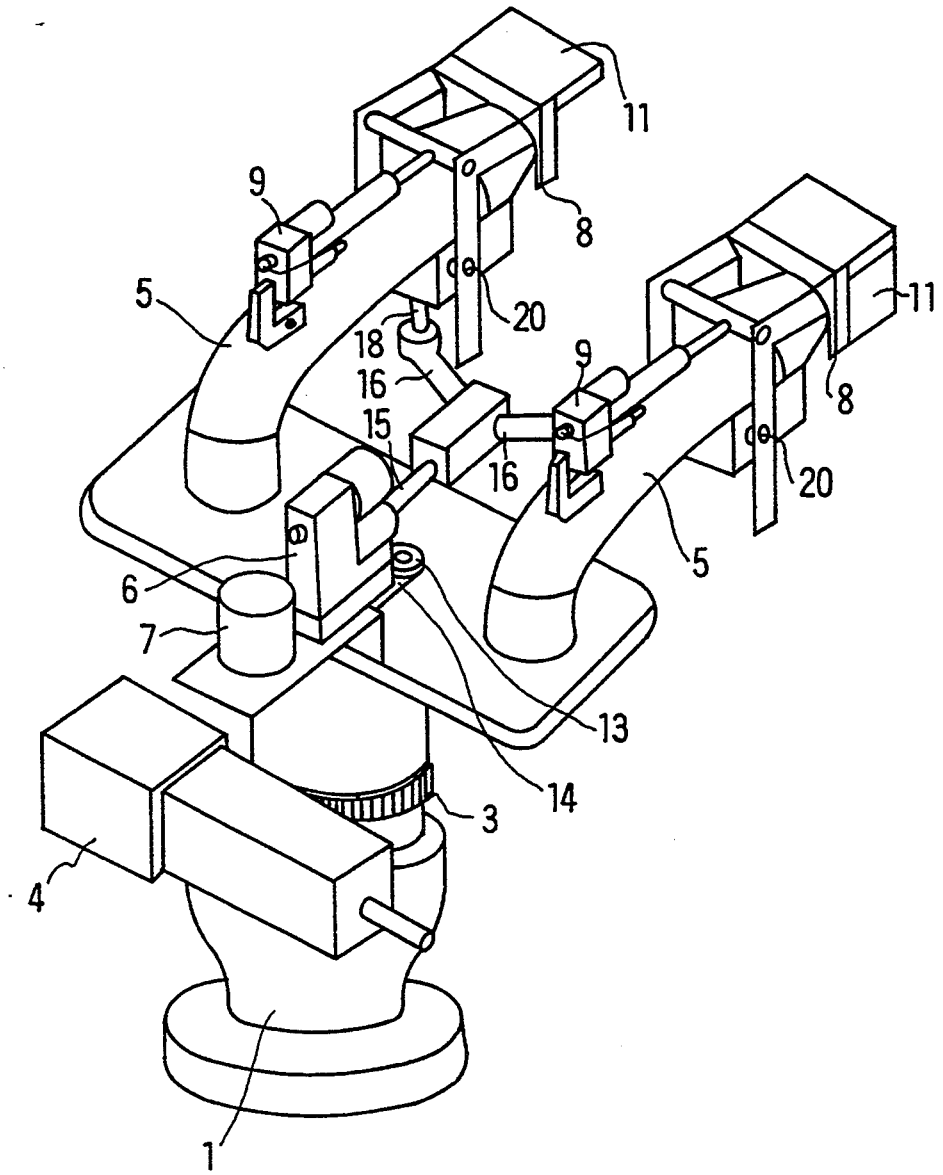
FIG. 3 is a schematic perspective view of the embodiment shown in FIG. 1.

As shown in FIGS. 2 and 3, a rotatable table 2*a* connected to the rotatable member 2 supports a pair of nozzles 5 and 5 which are horizontally pivotable with respect to the rotatable table 2*a*. As shown in FIG. 3, an actuator 6 is provided between the nozzles 5, 5. The actuator 6 is connected to the nozzles 5, 5 by means of: a rod 15 protruding from the actuator 6; a pair of links 16, 16 connected to an end portion of the rod 15; and pins 18, 18 each connected at one end portion to an end portion of a corresponding link 16 and at the other end portion to a corresponding nozzle 5.

Thus, if the actuator pushes the rod 15 out, the nozzles 5, 5 are turned away from each other by means of the links 16, 16 and the pins 18, 18. In other words, the angle between the nozzles 5 and 5 is controlled by the actuator 6 (referred to as "the inter-nozzle angle actuator 6").

In the back of the inter-nozzle angle actuator 6, a rotary encoder 7 is provided for detecting the rotational angle of the rotatable member 2. As shown in FIGS. 1(*a*) and 3, an input shaft protruding downwards from the rotary encoder 7 is connected by a belt 14 to a pulley 13 which is provided coaxially with the rotation axis of the rotatable table 2*a*. Thus, when the rotatable member 2 is being rotated, the rotational angle thereof is inputted to the rotary encoder 7 by means of the pulley 13 and the belt 14.

A contact projection 40 is provided on an end portion of the input shaft of the rotary encoder 7. As indicated in FIG. 1(*b*), a bottom view of the input shaft portion, if the input shaft is rotated, the contact projection 40 contacts and thus operates a limit switch 42 or 43, both of which are supported by a supporting member 41. Using a detection signal from the limit switch 42 or 43, a rotational reference position of the nozzles 5, 5 can be detected.

Alternatively, a rotational reference position of the nozzles 5, 5 may be detected by other means, as indicated by broken lines in FIG. 1(*a*). The supporting table 1 is provided with a supporting member 44 which supports a limit switch 45. A contact projection 46 is provided on the rotatable member 2. When the rotatable member 2 is rotated, the projection contact 44 contacts and thus operates the limit switch 45, thus detecting the rotational reference position.

As shown in FIG. 1(*a*), deflectors 8, 8 are provided in front of the nozzles 5, 5. Each deflector 8 is supported by a deflector cover 10 which is provided pivotably about a shaft 20. Thus, the deflectors 8 can be placed in front of the respective nozzles 5, 5. A deflector actuator 9 is mounted on each nozzle 5 by means of a supporting member 21, and a rod 22 of each deflector actuator 9 is connected to a rear portion of the corresponding deflector cover 10.

The deflector actuators 9, 9 swing the respective deflector covers 10, 10 up and down about the shafts 20, 20 by driving the rods 22, 22 back and forth. The deflectors 8, 8 can be thus positioned above the nozzles 5, 5 and in front thereof.

Further, a deflector side cover 11 is provided for each deflector 8.

Figure 4A:
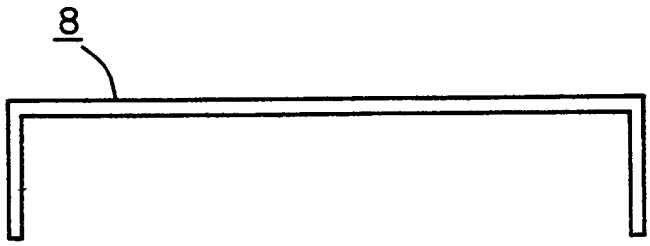
FIG. 4*a* illustrates a top view a deflector employed in the firefighting double-nozzle deluge gun of the present invention.
Figure 4B:
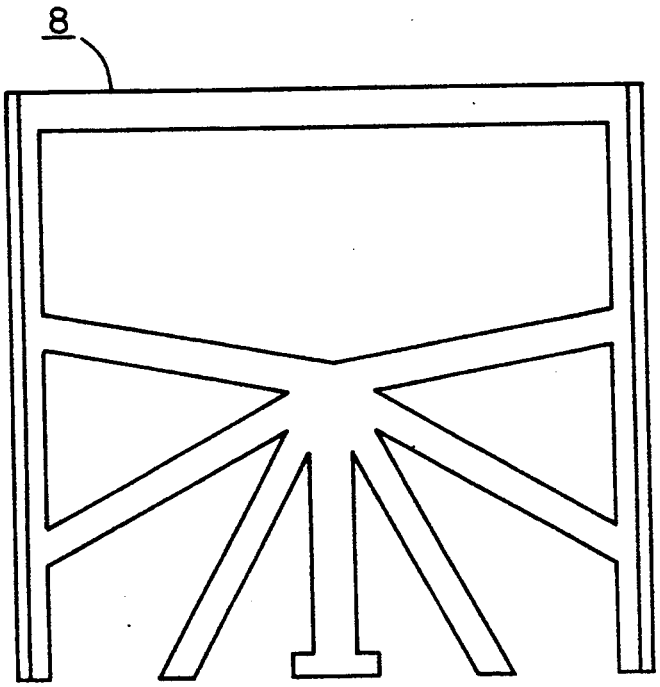
FIG. 4*b* is an elevational view of the deflector in FIG. 4*a;*

FIG. 4(*a*) and 4(*b*) are a plan view and a front view of the deflector 8 according to this embodiment of the present invention. As shown in FIG. 4(*a*), the deflector 8 is folded in the shape of a square "U". As shown in FIG. 4(*b*), it has an opening pattern whose upper portion is wide open and whose lower portion is provided with a radially extending stopper plate. During a very short range watering operation, the deflectors 8, 8 are positioned in front of the nozzles 5, 5, thus achieving an optimal watering pattern.

Figure 5:
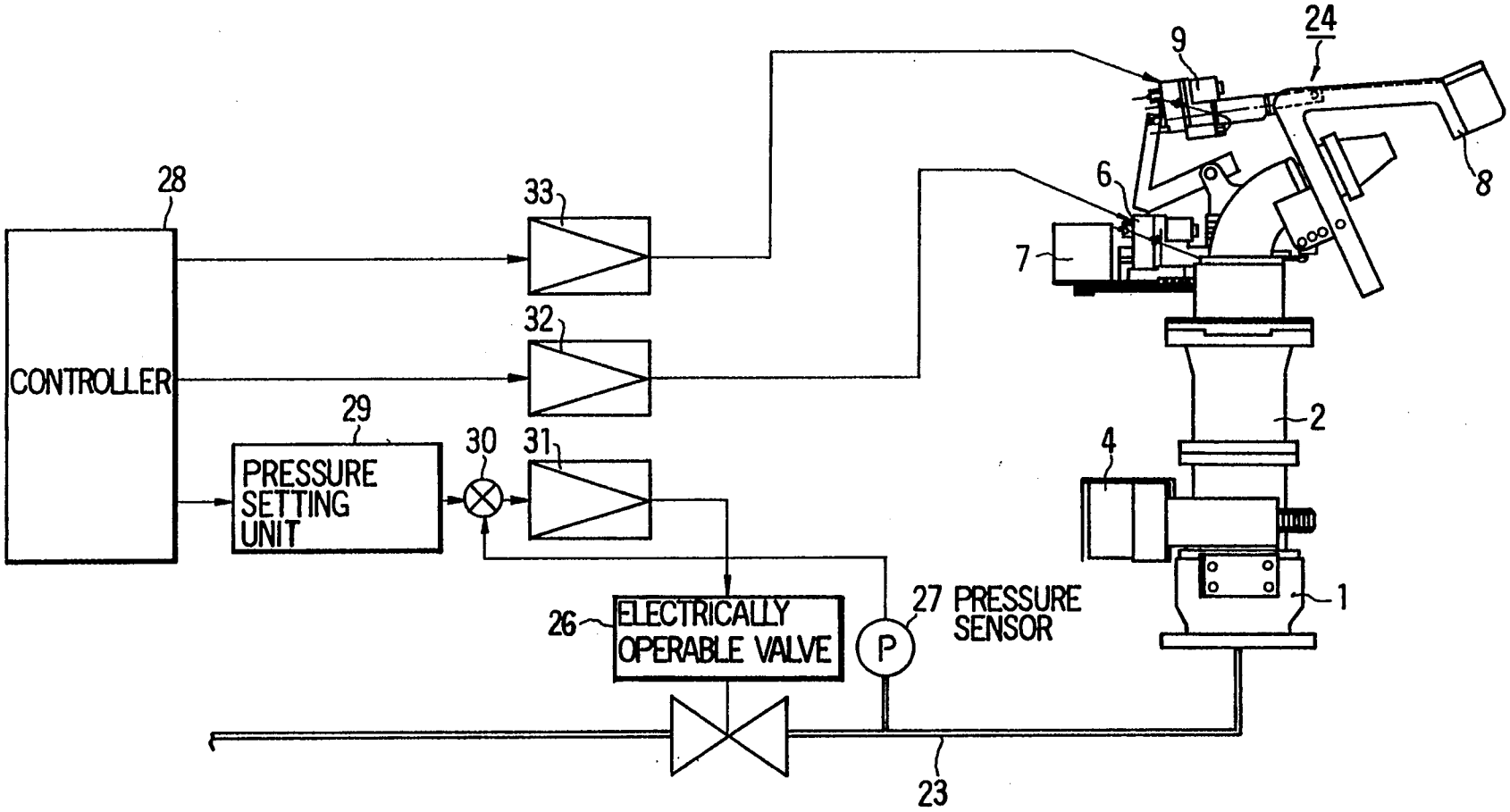
FIG. 5 is a block diagram of a water-shooting control method according to the present invention.

FIG. 5 is a block diagram of control means employed in the firefighting double-nozzle deluge gun of the present invention.

Hydrant piping 25 for conveying water from pump means is connected to the supporting table 1 of the firefighting double-nozzle deluge gun 24 of the present invention. The hydrant piping 25 is provided with an electrically operable valve 26 and a pressure sensor 27. According to the present invention, a controller 28 controls the water-reaching range of the double-nozzle deluge gun 24 by simultaneously controlling the water-shooting pressure and the angle between the nozzles 5, 5.

A pressure setting unit 29, an adding unit 30 and a power amplifier 31 are provided for controlling the water-shooting pressure. The electrically operable valve 26 and the pressure sensor 27 are connected by a feedback loop for pressure control. More specifically, after the pressure setting unit 29 sets a shooting pressure which has been determined by the controller 28 in accordance with a desired range, the power amplifier 31 opens the electrically operable valve 26 in accordance with a deviation output from the adding unit 30, in order to achieve the target value, that is, the pressure value set by the pressure setting unit 29.

As the electrically operable valve 26 opens, the pressure increases. The pressure is monitored by the pressure sensor 27 and inputted back to the adding unit 30. The electrically operable valve 26 is controlled so that the difference between the pressure detected by the pressure sensor 27 and the target pressure set by the pressure setting unit 29 is reduced to zero.

Further, the controller 28 controls a power amplifier 32 for driving the inter-nozzle angle actuator 6 and a power amplifier 33 for driving the deflector actuator 9.

The controller 28 controls the angle between the nozzles 5, 5 and the water-shooting pressure in accordance with desired water-reaching ranges. This control is performed on the basis of predetermined control parameters, for example, control parameters shown in FIG. 6.

Figures 6, 7:
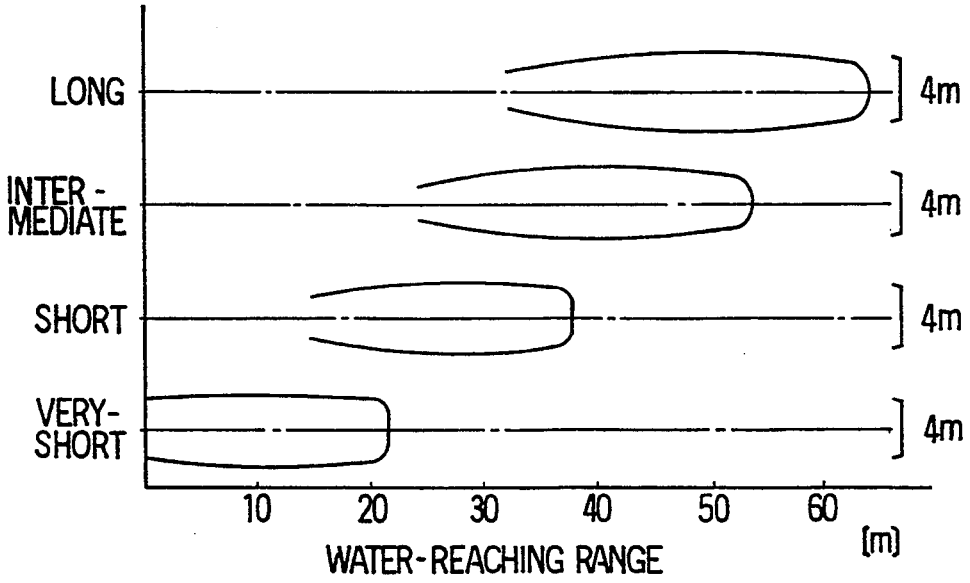
FIG. 6 indicates examples of parameters of angles between the nozzles, water-shooting pressures, etc., used in the water-shooting control method of the present invention.
FIG. 7 illustrates variations of the watering patterns according to the present invention.

As shown in FIG. 6, the control parameters of the inter-nozzle angle, the water-shooting pressure and whether or not to use the deflectors are determined in accordance with four different modes: the long range, the intermediate range, the short range, and the very short range.

Specifically, in the long range of 40–60 meters: the inter-nozzle angle is 0°; the pressure is 7 kg/cm2; and the deflectors are not used. In the intermediate range of 30–50 meters, the inter-nozzle angle is 5°; the pressure is reduced to 5 kg/cm2; and the deflectors are not used.

In the short range of 18–35 m, the inter-nozzle angle is further increased to 8°; the pressure is further reduced to 3 kg/cm2; and the deflectors are used in such a manner that only portions thereof are hit by water. The deflectors are used during the short range mode because the reduced water pressure during this mode would likely result in two separated narrow bar-shape watering patterns if the deflectors were not used. By using the deflectors to partially intervene in the water streams from the nozzles 5 and 5, a watering pattern having a desirable width can be obtained.

In the very short range of 0–20 m, the inter-nozzle angle is 8°, the same angle as during the short range mode; the pressure is increased to 5 kg/cm2, the same level as during the intermediate range mode; and the deflectors are used.

The control parameters regarding the inter-nozzle angle, the water-shooting pressure and whether or not to use the deflectors, as shown in FIG. 6, are preset in the controller 28. Therefore, the inter-nozzle angle and the pressure are controlled in accordance with the distance from the nozzles to a fire source, by using an operational unit of the controller 28. Further, if a fire source is in a close range, the deflectors are used.

FIG. 7 illustrates example watering patterns of the double-nozzle deluge gun of the present invention, on the basis of the control parameters shown in FIG. 6.

As shown in FIG. 7, the double-nozzle deluge gun according to the present invention achieves substantially rectangular watering patterns having widths of about 4 meters, a watering pattern width required for this type of deluge gun, substantially along all the lengths, in any of the long, intermediate, short and very short ranges. Normally, the deflectors used during the very short range mode would scatter water, resulting in an excessively widened watering pattern. However, according to the present invention, because the deflectors 8, 8 are provided with the deflector side covers 11 and 11, the watering pattern will not be excessively widened but assumes a substantially rectangular pattern which has a width of about 4 meters and extends along the distance from 0 to 20 meters.

Figure 8:
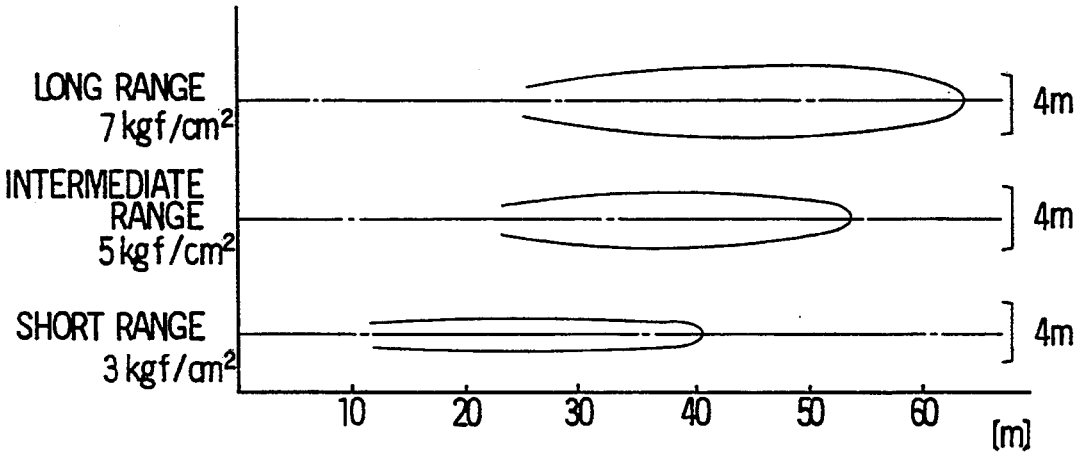
FIG. 8 illustrates variations of the watering patterns of a single-nozzle deluge gun according to the related art.

According to the conventional art, the width of the watering pattern is reduced as the water-reaching range is reduced, as shown in FIG. 8. However, according to the present invention, because the nozzles 5, 5 are set in parallel (the inter-nozzle angle being 0°) during the long range mode and the inter-nozzle angle is increased from 0° as the range decreases, (the ends of the nozzles are turned away from each other) a watering pattern having a width of about 4 m is achieved in any range. Thus, a substantially large effective watering area can be unfailingly obtained in any range.

The control parameters shown in FIG. 6 are mere examples, and the present invention is not limited to those figures.

Further, the invention is not limited to the disclosed embodiments. To the contrary, the invention is intended to cover various modifications and equivalent arrangements included within the spirit and scope of the appended claims.

What is claimed is:

1. A firefighting double-nozzle deluge gun comprising:

a pair of nozzles arranged side by side pivotally on a rotatable member; said nozzles forming an angle therebetween;

inter-nozzle angle control means for controlling said angle between said nozzles, said angle being measured between two lines obtained by projecting center lines of said nozzles onto a horizontal plane; each of said nozzles having a deflector positioned in front of the nozzle during a short range watering operation; said deflector having a side cover for preventing a water stream having passed through said deflector from spreading excessively sideways; means for adjusting said angle between said nozzles and water-shooting pressure in accordance with desired water-reaching ranges for achieving an optimal watering pattern in any range between a substantially long range and a short range, an optimal watering pattern being achieved for a relatively very short range by controlling said deflector, said water-shooting pressure and said angle between said nozzles, said watering pattern being maintained constant from long range to substantially short range.

2. A gun as defined in claim 1, wherein said adjusting means comprises:

an actuator for adjusting said angle between said nozzles;

a pair of links connected to an end portion of a rod protruding from said actuator; and a pair of pins each connected at one end to an end portion of one of said pair of links and at the other end to one of said nozzles.

3. A method for controlling a firefighting double-nozzle deluge gun, comprising the steps of: arranging a pair of nozzles side by side pivotally on a rotatable member, said nozzles forming an angle therebetween; controlling said angle between said nozzles; measuring said angle between two lines obtained by projecting center lines of said nozzles onto a horizontal plane; positioning a deflector in front of each nozzle during a short range watering operation; providing said deflector with a side cover for preventing a water stream having passed through said deflector from spreading excessively sideways; adjusting said angle between said nozzles and water-shooting pressure in accordance with desired water-reaching ranges for achieving an optimal watering pattern in any range between a substantially long range and a short range, an optimal watering pattern being achieved for a relatively very short range by controlling said deflector, said water-shooting pressure and said angle between said nozzles; and controlling said angle, the water-shooting pressure and whether or not to use deflectors on basis of four modes comprising a long range mode, an intermediate range mode, a short range mode, and a very short range mode for achieving an optimal watering pattern during each of said modes, said watering pattern being maintained constant from long range to substantially short range.

4. A method as defined in claim 3, wherein said range is substantially 40 to 60 meters during said long range mode, said angle between said nozzles being substantially 0° and said water-shooting pressure being substantially 7 kg/cm$^2$ and said deflectors being absent.

5. A method as defined in claim 3, wherein said range is substantially 30 to 50 meters during said intermediate range mode, said angle between said nozzles being 5° and said water-shooting pressure being substantially 5 kg/cm$^2$ and said deflectors being absent.

6. A method as defined in claim 3, wherein said range is substantially 18 to 35 meters during said short range mode, said angle between said nozzles being substantially 8° and said water-shooting pressure being substantially 3 kg/cm$^2$; and arranging said deflectors so that water strikes only portions of said deflectors.

7. A method as defined in claim 3, wherein said range is substantially 0 to 20 meters during said very short range mode, said angle between said nozzles being substantially 8° and said water-shooting pressure being substantially 5 kg/cm$^2$ and said deflectors being present.

8. A method for controlling a firefighting double-nozzle deluge gun, comprising the steps of: arranging a pair of nozzles side by side pivotally on a rotatable member, said nozzles forming an angle therebetween; controlling said angle between said nozzles; measuring said angle between two lines obtained by projecting center lines of said nozzles onto a horizontal plane; positioning a deflector in front of each nozzle during a short range watering operation; providing said deflector with a side cover for preventing a water stream having passed through said deflector from spreading excessively sideways; adjusting said angle between said nozzles and water-shooting pressure in accordance with desired water-reaching ranges for achieving an optimal watering pattern in any range between a substantially long range and a short range, an optimal watering pattern being achieved for a relatively very short range by controlling said deflector, said water-shooting pressure and said angle between said nozzles; and controlling said angle, the water-shooting pressure and whether or not to use deflectors on basis of four modes comprising a long range mode, an intermediate range mode, a short range mode, and a very short range mode for achieving an optimal watering pattern during each of said modes; said range being substantially 40 to 60 meters during said long range mode, said angle between said nozzles being substantially 0° and said water-shooting pressure being substantially 7 kg/cm$^2$ and said deflectors being absent; said range being substantially 30 to 50 meters during said intermediate range mode, said angle between said nozzles being 5° and said water-shooting pressure being substantially 5 kg/cm$^2$ and said deflectors being absent; said range being substantially 18 to 35 meters during said short range mode, said angle between said nozzles being substantially 8° and said water-shooting pressure being substantially 3 kg/cm$^2$; and arranging said deflectors so that water strikes only portions of said deflectors; said range being substantially 0 to 20 meters during said very short range mode, said angle between said nozzles being substantially 8° and said water-shooting pressure being substantially 5 kg/cm$^2$ and said deflectors being present, said watering pattern being maintained constant from long range to substantially short range.

* * * * *